United States Patent [19]

Hässler et al.

[11] 4,067,379

[45] Jan. 10, 1978

[54] METHOD FOR THE MANUFACTURE OF MULTILAYERED CONTACTS FOR MEDIUM-VOLTAGE VACUUM POWER CIRCUIT BREAKERS

[75] Inventors: Heinrich Hässler, Wendelstein; Horst Kippenberg, Nurñberg, both of Germany

[73] Assignee: Siemens Aktiengesellschaft, Munich, Germany

[21] Appl. No.: 713,597

[22] Filed: Aug. 11, 1976

[30] Foreign Application Priority Data

Aug. 13, 1975 Germany ..... 2536153

[51] Int. Cl.[2] ..... H01R 9/00; B22D 19/00

[52] U.S. Cl. ..... 164/69; 29/182.1; 29/630 C; 200/264; 164/80; 164/98; 164/6; 428/558

[58] Field of Search ..... 29/630 C, 630 R, 420, 29/422, 182.1, 527.6; 200/264, 265, 266, 268, 262, 270; 75/208 R; 164/69, 6, 80, 98, 110, 112

[56] References Cited

U.S. PATENT DOCUMENTS

| | | | |
|---|---|---|---|
| 3,592,987 | 7/1971 | Lempert | 200/144 B |
| 3,828,428 | 8/1974 | Wayland | 29/630 C |
| 3,985,512 | 10/1976 | Hassler et al. | 29/182.1 |

*Primary Examiner*—James R. Duzan

*Attorney, Agent, or Firm*—Kenyon & Kenyon, Reilly, Carr & Chapin

[57] ABSTRACT

A method for producing multilayered contacts for medium-voltage vacuum power circuit breakers is provided comprising impregnating under vacuum with oxygen-free, liquid copper, a composite body of metal powders consisting of at least 35% by volume of a metal selected from the group consisting of chromium and vanadium and at least one metal selected from the group consisting of chromium, vanadium, cobalt, nickel and iron, in a crucible comprised of a metal selected from the group consisting of iron, steel, and chromium-nickel steel; and removing at least part of the crucible to expose a contact surface.

11 Claims, 4 Drawing Figures

METHOD FOR THE MANUFACTURE OF MULTILAYERED CONTACTS FOR MEDIUM-VOLTAGE VACUUM POWER CIRCUIT BREAKERS

BACKGROUND OF THE INVENTION

1. Field of The Invention

The invention relates to a method for the manufacture of multilayered contacts for medium-voltage vacuum power circuit breakers.

2. Description Of The Prior Art

Formerly, contact materials for medium-voltage vacuum power circuit breakers comprised alloys with a copper base. It has been found, however, that it is advantageous to use composite materials with burn-off-reducing and getter components to lengthen contact life and to promote residual gas adsorption. The contact material should have a smoothly-fused surface after a switching stress and must not have a tendency to form points, droplets, or loose fragments in order to ensure maximum dielectric strength after power interruptions. It has been found that these requirements can be met simultaneously by a material which consists of copper contained in a composite material consisting of at least 35% by volume of chromium or vanadium and the remainder consisting of chromium, vanadium, cobalt, nickel or iron.

The addition of metals to the composite material with melting points below 1400° C is not desirable because the resulting burn-off resistance is too low. Metals with a melting point of over 2000° C, on the other hand, no longer lead to smoothly-fused surfaces in every case after a switching stress thereby adversely affecting the dielectric strength. Other metals having melting points between 1400° C and 2000° C, such as zirconium and titanium, cannot be used in the contact layer because they form low-melting inter-metallic compounds of low burn-off resistance with the copper phase.

The contact materials mentioned above are produced by the well-known vacuum-sintering impregnating method, wherein a composite body of metal powders, usually a pressed powder blank or a sintered body, of the metals is impregnated with liquid copper at a temperature above the melting point of copper in a crucible under vacuum. Considerable difficulties arise if the impregnating crucible containing the composite materials and the copper, or the impregnating supports on which composite materials are placed, are of large area because the reactive metals contained in the composite materials, particularly chromium and vanadium, react with all known materials used in such crucibles or supports. Due to this reaction (called set-in of alloying), undesired components of the crucible or support material are introduced into the contact layer material by diffusion.

To avoid the above difficulties, the impregnating can also be done without a crucible by using supports with a small area rather supports with a large area. With this method, however, a change occurs in the boundary surface tension of the impregnating copper at the support points of the contact blank, unavoidably resulting in segregation of the copper and underimpregnation of the composite material.

A further difficulty arises when joining the contacts to the support studs because the reactive metals contained in the contact, such as chromium and vanadium, lead to oxidation of the contact surface because of their high oxygen affinity, even when soldering takes place in a vacuum, and thereby prevent wetting by the commonly-used solder metals. To avoid these difficulties, the contact is provided with an electrodeposited metal layer of, for example, nickel or copper, prior to being soldered. With this method however the danger exists that the contact may become contaminated with electrolyte residue. There are several known special solders, which contain phosphorus or maganese as deoxidizing components, which permit soldering without an electrodeposited layer, but these solders are not usable for vacuum power circuit breakers because of the low boiling point of the deoxidizing additives.

SUMMARY OF THE INVENTION

It is an object of this invention to provide a method for preparing contacts of the kind mentioned above while at the same time overcoming the difficulties cited.

The present invention provides a method for the manufacture of pore-free, multilayered contacts for medium-voltage vacuum power circuit breakers which comprises impregnating under vacuum with oxygen-free, liquid copper a composite body of metal powders consisting of at least 35% by volume of a metal selected from the group consisting of chromium and vanadium and at least one metal selected from the group consisting of chromium, vanadium, cobalt, nickel and iron, in a crucible comprised of a metal selected from the group consisting of iron, steel and chromium-nickel steel; and removing at least part of the crucible to expose a contact surface.

The composition of the crucible material is such that crucible constituents becoming part of the contact by alloying and subsequent diffusion are permitted or desired additives to the contact layer. This feature makes it possible to integrate the crucible or parts thereof into the contact, if desired. In addition to the manufacturing advantages, the method also results in easy solderability between the support stud and the bottom of the crucible which becomes an integral part of the contact, if the vessel material is chosen suitably. The use of such crucibles further ensures impregnation, free of pores, of the body comprised of metal powders by using an excess of impregnating material.

A further advantage of the invention is that the joining of low-porosity layers produced by powder metallurgy with other solid substrates or intermediate layers is possible without the need to carry out a separate joining process.

The contacts are produced in such a manner that the body of metal powder to be impregnated is either pressed into the crucible with a pressure of less than 1 ton/cm$^2$ or is placed in the impregnating crucible as a sintered, shaped part. In either case, the copper required according to the existing pore volume is placed in the form of a solid disk of oxygen-free material on the pressed or sintered body. The subsequent impregnating process is performed at about 1150° C in a vacuum. It has been found that the wall thickness of the crucible should be at least 0.5 mm.

The invention will be further described with reference to the following drawings and examples pertaining thereto.

EXAMPLE 1

Figure 1:
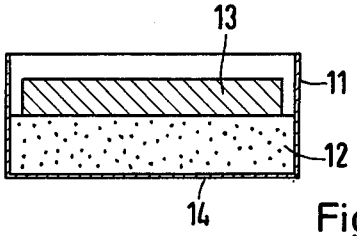
FIG. 1 is a cross-sectional view of a cylindrical impregnating crucible with contents prior to impregnation.

In the cylindrical impregnating crucible 11 of FIG. 1 of deep-drawn sheet metal of unalloyed steel (DIN 1623) having a thickness of 1 mm, a diameter of 80 mm and a height of 30 mm, a sintered body 12 of chromium with fill factor of 50% by volume is placed. A copper disk 13 of oxygen-free copper is placed on the sintered body 12. The sintered body is impregnated in a vacuum at a temperature of about 1150° C until the sintered body 12 is completely impregnated. After the impregnating is completed, the outside walls of the impregnating crucible 11 are machined off, while the bottom 14 of the vessel 11, because it is alloyed to the contact, is preserved as a solderable substrate for joining it to the current-carrying stud. Alternatively, a body composed of metal powders may be used to fill the crucible rather than a sintered body. For example, chromium powder can be poured or pressed into the vessel so that the sintering and infiltration process can proceed in a single heat treating operation.

EXAMPLE 2

Figure 2:
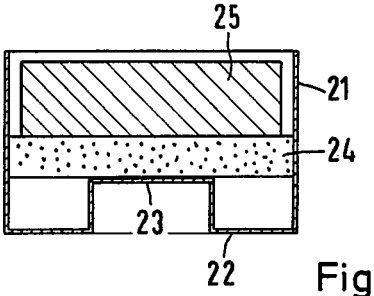
FIG. 2 is a cross-section view of a cylindrical impregnating crucible having a central cup-shaped reentrant salient on the crucible bottom, with contents prior to impregnation.

Referring to FIG. 2, the impregnating crucible 21 is comprised of deep-drawn sheet metal of unalloyed steel (DIN 1623), the bottom 22 of which has a central cup-shaped reentrant salient 23. A sintered disk 24 of vanadium with a fill factor of 50% by volume is placed in the vessel 21, so that it rests on the salient 23. A copper disk 25 is placed on the sintered disk 24. After the impregnating process of Example 1 is completed, and the walls of the crucible are machined off, a two-layer contact is obtained, the switching surface of which is the impregnated sintered material; and the copper-underside of which contains a cup-shaped, reentrant salient lined with a steel wall, 23, into which the current-carrying stud can be soldered.

EXAMPLE 3

Figure 3:
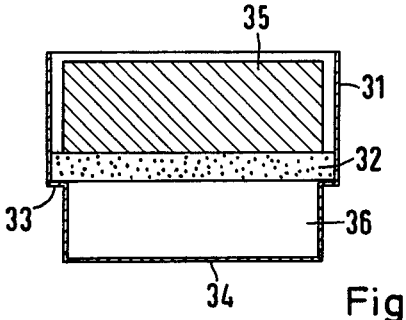
FIG. 3 is a cross-sectional view of a stepped crucible with contents prior to impregnation.

In FIG. 3 a stepped crucible 31 of deep-drawn sheet metal of unalloyed steel (DIN 1623) is used, in which is placed a sintered disk 32 of a mixture of chromium, cobalt and nickel with at least 35% by volume of chromium having a fill factor of 50% by volume, the diameter of which is chosen so that it rests on the stepped shoulder 33 of the crucible wall and thus is given a certain spacing from the bottom 34. A copper disk 35 is placed on the sintered disk 32. During the impregnating process, as per Example 1, the space 36 between the sintered disk 32 and the bottom 34 of the crucible is also filled by the copper impregnating material. After the wall of the crucible 31 is machined off, a multilayer contact blank is obtained, which has a switching layer of impregnated sintered material and a solderable substrate layer consisting of the alloyed-on bottom 34 of the crucible 31. Alternatively, a conically enlarged design of the crucible instead of the stepped design for receiving the sintered disk may be chosen.

EXAMPLE 4

Figure 4:
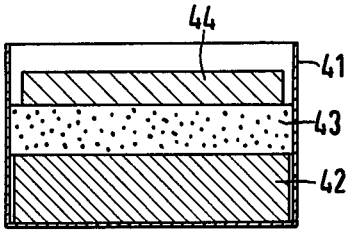
FIG. 4 is a cross-section view of a crucible which contains an inserted steel disk as the bottom layer of its contents, with contents prior to impregnation.

In FIG. 4, a deep-drawn crucible 41 of thin sheet metal of unalloyed steel (DIN 1623) is used as the impregnating crucible, into which an iron or chromium-nickel steel disk is placed. A sintered body 43 of chromium with a fill factor of 50% by volume is placed on the disk 42. An oxygen-free copper disk 44 is placed on the sintered body 43. After the impregnating process as used in Example 1 was completed, the sintered body 43 was joined to the CrNi disk 42. Subsequently, the walls and the bottom of the crucible are removed, exposing both the switching layer surface and the solderable substrate surface.

What is claimed is:

1. A method for preparing pore-free, multilayered contacts for medium-voltage vacuum power circuit breakers which comprises:

a. impregnating under vacuum with oxygen-free, liquid copper a composite body of metal powders consisting of at least 35% by volume of a metal selected from the group consisting of chromium and vanadium and at least one metal selected from the group consisting of chromium, vanadium, cobalt, nickel and iron, in a crucible comprised of a metal selected from the group consisting of iron, steel and chromium-nickel steel; and b. removing at least part of the crucible to expose a contact surface.

2. The method according to claim 1 wherein the body is a sintered body.

3. The method according to claim 1 wherein the body is a pressed powder blank.

4. The method according to claim 1 wherein the walls of the crucible are removed.

5. The method according to claim 1 in which the crucible is made from deep-drawn sheet metal and has a central cup-shaped reentrant salient on the crucible bottom and the part of the crucible removed is the walls of the crucible.

6. The method according to claim 1 in which the crucible is made from deep-drawn sheet metal and contains means integral with the inner wall of the crucible to retain the composite body at a definite spacing above the bottom of the crucible; the body having such dimensions that the composite body fits inside the crucible, and is held at a definite spacing from the bottom of the crucible by said retaining means, said copper filling said spacing above the bottom of the crucible; and the part of the crucible removed is the walls of the crucible.

7. The method according to claim 6 wherein the crucible is a stepped crucible.

8. The method according to claim 1 wherein a flat piece of metal selected from the group consisting of iron and chromium-nickel steel is located on the bottom of the crucible, the crucible is made from deep-drawn sheet metal, the composite body is a sintered body, and the walls and the bottom of the crucible are removed.

9. The method according to claim 1 in which said body is formed outside the vessel.

10. The method according to claim 1 in which said body is formed inside the vessel.

11. A method for preparing pore-free, multilayered contacts for medium voltage vacuum power circuit breakers which comprises:

a. forming a composite body of sintered or pressed metal powders, consisting of at least 35% by volume of an element selected from the group consisting of chromium and vanadium and at least one element selected from the group consisting of chromium, vanadium, cobalt, nickel and iron;

b. heating the composite body under vacuum with oxygen-free copper in a crucible made from deep-drawn sheet metal said metal selected from the group consisting of iron, steel and chromium-nickel steel to a temperature above the melting point of copper until said composite body is impregnated with said copper; and c. removing the walls of the crucible.

* * * * *